US006786025B2

(12) United States Patent
Futase

(10) Patent No.: US 6,786,025 B2
(45) Date of Patent: Sep. 7, 2004

(54) APPARATUS FOR SUPPLYING AND PACKING A LIQUID COMPOSITION CONTAINING GRANULAR CONSTITUENTS

(75) Inventor: Katsunori Futase, Saitama (JP)

(73) Assignee: Taisei Lamick Co., Ltd., Saitama (JP)

( * ) Notice: Subject to any disclaimer, the term of this patent is extended or adjusted under 35 U.S.C. 154(b) by 0 days.

(21) Appl. No.: 10/354,017

(22) Filed: Jan. 30, 2003

(65) Prior Publication Data

US 2003/0110742 A1 Jun. 19, 2003

Related U.S. Application Data

(62) Division of application No. 09/665,411, filed on Sep. 20, 2000, now Pat. No. 6,568,157.

(30) Foreign Application Priority Data

Mar. 24, 2000 (JP) ..... 2000-83591
May 12, 2000 (JP) ..... 2000-139913

(51) Int. Cl.[7] ..... B65B 9/06; B65B 3/26
(52) U.S. Cl. ..... 53/551; 53/239
(58) Field of Search ..... 53/239, 551; 141/100, 141/104, 105, 236, 286

(56) References Cited

U.S. PATENT DOCUMENTS 3,626,997 A 12/1971 Whitaker et al.
3,911,972 A 10/1975 Hubers et al.
4,604,854 A 8/1986 Andreas
4,606,174 A 8/1986 Berg
4,608,810 A 9/1986 Bordini
4,784,697 A * 11/1988 Bordini ..... 53/551
4,819,406 A 4/1989 Redmond
5,067,310 A * 11/1991 Yamanaka ..... 53/551
6,332,305 B1 12/2001 Takahashi

FOREIGN PATENT DOCUMENTS

JP 6437303 2/1989
JP 1188328 7/1989

* cited by examiner

*Primary Examiner*—Stephen F. Gerrity
(74) *Attorney, Agent, or Firm*—Greenblum & Bernstein, P.L.C.

(57) ABSTRACT

During automatic supply and packing of a liquid composition containing granular constituents, a master liquid, not containing the granular constituents, of the liquid composition is continuously supplied to a packing bag formed from a packing film by making bottom and top seals, in this order, on the packing bag with the packing film being stroked and squeezed to remove a part of the master liquid from bag portions where the bottom and top seals are to be formed, and a second liquid, containing the granular constituents, of the liquid composition is intermittently supplied into the packing bag between the bottom and top seals. Thereby, a liquid composition containing granular constituents can be packed with the nearly same efficiency as that in continuous supply and packing of a liquid.

6 Claims, 3 Drawing Sheets

APPARATUS FOR SUPPLYING AND PACKING A LIQUID COMPOSITION CONTAINING GRANULAR CONSTITUENTS

CROSS-REFERENCE TO RELATED APPLICATIONS

This application is a divisional of application Ser. No. 09/665,411, filed Sep. 20, 2000, now U.S. Pat. No. 6,568,157, and claims priority of Japanese Application Nos. 2000-83591, filed Mar. 24, 2000, and 2000-139913, filed May 12, 2000. The entire disclosure of application Ser. No. 09/665,411 is considered as being part of the disclosure of this application, and the entire disclosure of application Ser. No. 09/665,411 is expressly incorporated by reference herein in its entirety.

BACKGROUND ART (a) Technical Field

The present invention relates to a field of automatic filling and packing, and more particularly to a method of packing a liquid composition containing granular constituents and a liquid composition supplying apparatus, adopted in an automatic filling and packing machine to supply and pack, at a high speed, a liquid composition containing regularly or irregularly shaped solids or other granular into a bag formed from a continuously fed packing film having a thermally fusible layer, which is a lamination film in many cases.

(b) Prior Art Statement

When packing in a bag formed from a packing film a liquid composition containing soft or hard granular constituents such as a dressing or hamburger sauce containing minced vegetables or granular spice, pasta sauce containing minced meat, starch syrup containing sesame seeds for fried sweet potato, etc. using an automatic filling and packing machine, a poor seal takes place from time to time. The poor seal is caused by the granular constituents caught between the films at the top and bottom heat seals of the packing bag. More particularly, as the water content of the granular constituents caught between the films at the heat seals is expanded in volume when it is vaporized, the films at the heat seal are not well fused and joined to each other or the films are peeled off. It is the typical conventional measure to make a bottom seal to bottom a packing bag before a liquid composition to be packed is supplied into the bag formed from the packing film, and then a top seal to form the top of the packing bag filled with the composition. The filling of the packing bag with the liquid composition is interrupted during heat sealing at the bottom and top of the packing bag, and the bottom and top seals of the packing bag are formed with such a long distance between them that the liquid composition put into the bag after forming of the bottom seal and rebounded from the bag bottom will not come to a position where the top seal is to be formed.

For intermittent supply of the liquid composition, it is necessary to cease the forming of the bag top until a predetermined amount of the liquid composition is put into the bag. Since the automatic filling and packing machine itself has to be in intermittent operations in this way, the liquid composition containing granular constituents cannot be supplied and packed with so high an efficiency as that in supply and packing of a liquid composition not containing granular constituents.

Also, when a liquid composition containing granular constituents is intermittently supplied and packed, if the liquid viscosity of the composition to be packed is high, the liquid composition will possibly drip unexpectedly after the supply is stopped and the drip be caught between the films at the heat seal of the packing bag, resulting in a poor seal as been described above.

Also, since the distance between the bottom and top of the packing bag is set long as described in the above, the yield of the packing film will be low. In addition, air inevitably sealed in the packing bag during the intermittent supply of the liquid composition, will cause the bag to have a large size and the content of the packing bag to easily be oxidized inside the bag.

SUMMARY OF THE INVENTION

It is a primary object of the present invention to overcome the drawbacks of the prior art by providing a method of packing a liquid composition containing granular constituents and a liquid composition supplying apparatus, in which the liquid composition containing granular constituents is separated into a master liquid not containing the granular constituents and a second liquid containing the granular constituents before supply to a bag formed from a packing film, the master liquid is continuously supplied into the bag by the automatic filling and packing machine as in the conventional packing of a liquid composition not containing granular constituents, while the second liquid is intermittently supplied into the master liquid already existing in the bag after a bottom seal is formed and before a top seal is formed, whereby the packing can be done with nearly same efficiency as that of the continuous supply and packing of a liquid.

It is an other object of the present invention to provide a method of packing a liquid composition containing granular constituents and a liquid composition supplying apparatus, capable of satisfactorily eliminating the drip of the liquid composition containing granular constituents which will cause a poor sealing.

It is still other object of the present invention to provide a method of packing a liquid composition containing granular constituents and a liquid composition supplying apparatus, capable of improving the yield of the packing film and preventing effectively the content of the packing bag from being oxidized inside the bag.

The method of packing the liquid composition containing granular constituents according to the present invention, is characterized in that during automatic supply and packing of the liquid composition containing granular constituents, a master liquid, not containing the granular constituents, of the liquid composition is continuously supplied into a packing bag formed from a packing film by making bottom and top seals, in this order, on the packing bag with the packing film being stoked and squeezed to remove a part of the master liquid from bag portions where the bottom and top seals are to be formed, and a second liquid, containing the granular constituents, of the liquid composition is intermittently supplied into the packing bag between the bottom and top seals.

The second liquid with granular constituents should preferably be prevented, by the pressure of the master liquid, from dripping.

Also the above object can be attained by providing an apparatus for supplying a liquid composition containing granular constituents into a packing bag, formed from a continuously fed packing film by forming longitudinal and lateral seals in this order to the packing film, the apparatus including a main conduit through which only a master liquid, not containing the granular constituents, of the liquid composition is supplied and at least a sub conduit through which a second liquid, containing the granular constituents, of the liquid composition is supplied, the sub conduit being open at the free end thereof in an area where the pressure of the master liquid acts.

To this end, the master liquid of the liquid composition containing granular constituents is continuously supplied into the packing bag as in the conventional packing of the liquid composition while the automatic filling and packing machine is continuously operating, and the second liquid containing the granular constituents is intermittently supplied into the master liquid existing in the packing bag between the bottom and top lateral seals formed by stroking and squeezing the packing bag at portions thereof where the bottom and top seals are to be formed. Thus, the time for supplying and packing the liquid composition can be made approximately equal to that for supply and packing of only the master liquid. Namely, the wait time for the liquid composition supply as in intermittent supply of the whole liquid composition to be packed is made unnecessary, so that the packing efficiency can be improved nearly to that for the conventional packing of ordinary liquid compositions.

Owing to the bottom and top lateral seals formed by stroking and squeezing the packing bag at positions where the seals are to be formed, the packing bag can be formed with the liquid composition containing the granular constituents supplied nearly full in the bag. Therefore, oxidation and loss of flavor of the content of the packing bag can effectively be eliminated, since air remaining in the bag can be purged almost completely or completely from inside the bag.

In addition, since the speed of intermittent supply of the second liquid can be made rather slower than that of the intermittent supply of all the liquid composition by intermittently putting the second liquid of relatively small quantity into the master liquid continuously supplied in the packing bag, the granular constituents in the second liquid can sufficiently be prevented from splashing to where the top seal is to be formed even with the distance between the bottom and top of the packing bag not set long. Thus, the yield of the packing film can be improved drastically and also it is possible to more effectively prevent the content of the packing bag from being oxidized inside the bag.

Further, to prevent the drip of the second liquid containing granular constituents, already intermittently supplied in the packing bag, by the pressure of the master liquid which is always under pressure because it is continuously supplied, no negative-pressure suction or the like has to be used after completion of the intermittent supply of the second liquid, and the unexpected drip of the second liquid can positively be prevented irrespectively of the viscosity of the second liquid. Thus, it is possible to eliminate the likelihood that a part of the granular constituents will be caught between the films at the heat seals of the packing bag.

To accurately make the intermittent supply of a predetermined amount of the second liquid containing granular constituents, the supply pressure for the second liquid should preferably be higher than the pressure of the master liquid since the pressure of the master liquid always acts on the outlet of the second liquid.

More preferably, the second liquid containing granular constituents should be condensed for intermittent supply to the packing bag. Thereby, the time for supplying the second liquid can be reduced to further improve the packing efficiency while a greater amount of the second liquid can be supplied intermittently.

Also, the liquid composition containing granular constituents should preferably be separated into a master liquid not containing the granular constituents and a second liquid containing the granular constituents before the above-mentioned supply is started, whereby an influence on the process for producing the liquid composition can be eliminated.

According to the present invention, the liquid composition supply apparatus includes a main conduit through which only a master liquid, not containing granular constituents, of a liquid composition is supplied into the packing bag formed from the continuously fed packing film, after forming the longitudinal seals, between the longitudinal and lateral seals formed one after another on the packing bag, and at least a sub conduit through which a second liquid, containing the granular constituents, of the liquid composition is supplied and having the free end thereof open in an area where the pressure of the master liquid acts.

Thereby, the pressure of the master liquid can be made to always act on the open end of the sub conduit by continuously supplying the master liquid incessantly as mentioned above to the packing bag. Therefore, it is possible to more positively prevent the second liquid from dripping subsequently by having the pressure of the master liquid act on the open end of the sub conduit in a direction of forcing back the second liquid upon stopping the pressurizing of the second liquid for supply especially when the intermittent supply of the second liquid through the sub conduit is stopped.

The free end of the sub conduit may be open in the middle of the main conduit. The open position of the free end should preferably be as near the open end of the main conduit as possible, which will more facilitate to adjust the timing of intermittent supply of the second liquid.

Otherwise, with the free ends of the main and sub conduits being open inside a common nozzle whose end is drawn, the liquid composition supplying apparatus according to the present invention can be designed more simple and the timing of intermittent supply can be controlled independently of the flow rate of the master liquid, etc.

More preferably, a separator to separate a liquid composition containing granular constituents into a master liquid not containing granular constituents and a second liquid containing the granular constituents should be provided to which the main and sub conduits are to be connected.

The invention provides an apparatus for supplying a liquid composition containing granular constituents into a packing bag formed from a continuously fed packing film by forming longitudinal and lateral seals in this order to the packing film, after forming the longitudinal seals, the apparatus comprising a packing bag forming system forming a packing bag from a packing film by making bottom and top seals, in this order, on the bag with stroking and squeezing of the packing film to remove a part of the master liquid from portions of the packing bag where the bottom and top seals are to be formed; a main conduit through which only a master liquid, not containing the granular constituents, of the liquid composition is continuously supplied; and at least one sub conduit through which a second liquid, containing the granular constituents, of the liquid composition is intermittently and automatically supplied into the packing bag between the bottom and top seals, the sub conduit being open at a free end thereof in an area where pressure of the master liquid acts; and said packing bag forming system, said main conduct and said at least one conduit being structured and arranged so that pressure of the master liquid prevents the second liquid containing the granular constituents from dripping during periods when the second liquid is not automatically supplied.

These objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
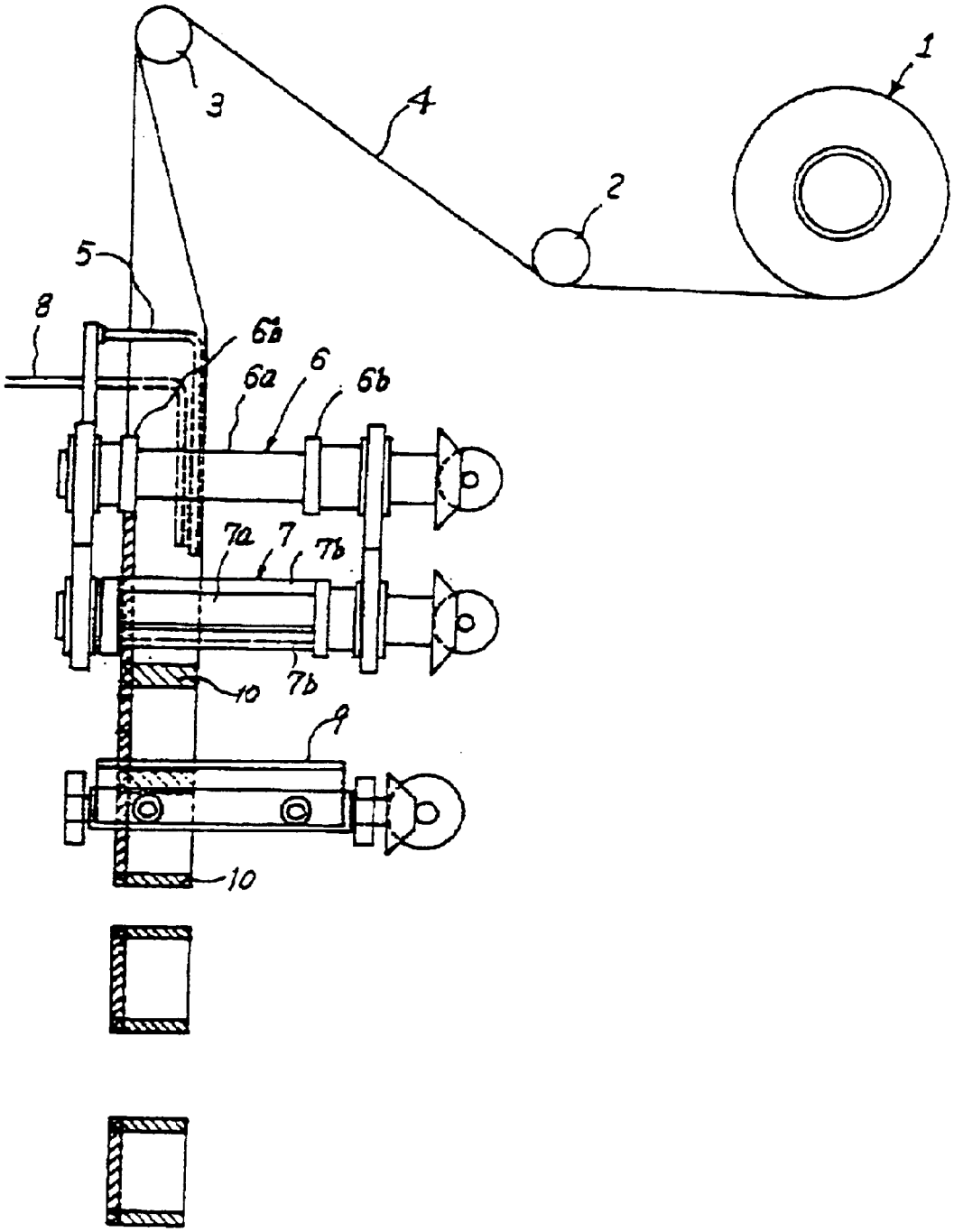
FIG. 1 is a schematic side elevation of an automatic filling and packing machine with which the liquid composition supplying apparatus according to the present invention can be used.

Referring now to FIG. 1, there is schematically illustrated in the form of a side elevation an automatic filling and packing machine with which the liquid composition supplying apparatus according to the present invention can be used. This machine is intended for use to automatically supply and pack a liquid composition containing viscous and granular constituents, etc. FIG. 1 shows only the major components of the automatic filling and packing machine for the simplicity of the illustration. As shown, the machine includes mainly a supply roll 1 from which a packing film 4 being a laminated film in many cases is supplied, guide rolls 2 and 3 to guide the packing film supplied from the supply roll 1, a film folder 5, longitudinal sealing rolls 6, lateral sealing rolls 7, a liquid composition supplying apparatus 8 according to the present invention, and cutter rolls 9.

The packing film 4 continuously supplied from the supply roll 1 is passed over the guide rolls 2 and 3, folded in the cross direction thereof by the film folder 5, and then passed between the longitudinal and lateral sealing rolls 6 and 7 in this order. Thus the folded sides of the packing film 4 are joined together along the opposite lateral free ends thereof and a line across the film 4 by the longitudinal and lateral sealing rolls 6 and 7. Namely, a longitudinal seal and lateral seals are formed as shown hatched in FIG. 1. Note that the packing film 4 is pulled by the longitudinal and lateral sealing rolls 6 and 7.

The longitudinal sealing rolls 6 are disposed in close proximity and in parallel, to each other, and each of them consists of a body 6*a* driven to rotate, and a pair of flange-shaped heat-sealing blades 6*b* contiguous to the ends of the body 6*a* and extending circumferentially of the body 6*a*. As mentioned above, the longitudinal sealing rolls 6 will form a longitudinal seal along the lateral free ends of the folded sides of the packing film 4 being passed between them.

The lateral sealing rolls 7 are disposed similarly to the longitudinal sealing rolls 6, and each of them consists of a body 7*a* driven to rotate and a pair of heat-sealing blades 7*b* extending longitudinally of the body 7*a* and circularly in the circumferential direction of the body 7*a*. Thus, the lateral sealing rolls 7 will form a lateral seal across the packing film 4 at every predetermined film-longitudinal distance.

As in the above, the longitudinal and lateral seals are given to the packing film 4. After the packing film 4 is folded and a longitudinal seal is given to the folded packing film 4, a liquid composition is supplied into the film bag by the supplying apparatus 8 while the folded packing film 4 are kept pressed between the lateral sealing rolls 7, and then the film bag 4 filled with the liquid composition is given a further lateral seal. The film bag 4 thus sealed is cut along the mid line of a lateral seal 10 by the cutter rolls 9 provided under the lateral sealing rolls 7. Note that each lateral seal 10 will be a top seal for a packing bag located below the cutting position, and a bottom seal for a packing bag located above the cutting position.

Figure 2:
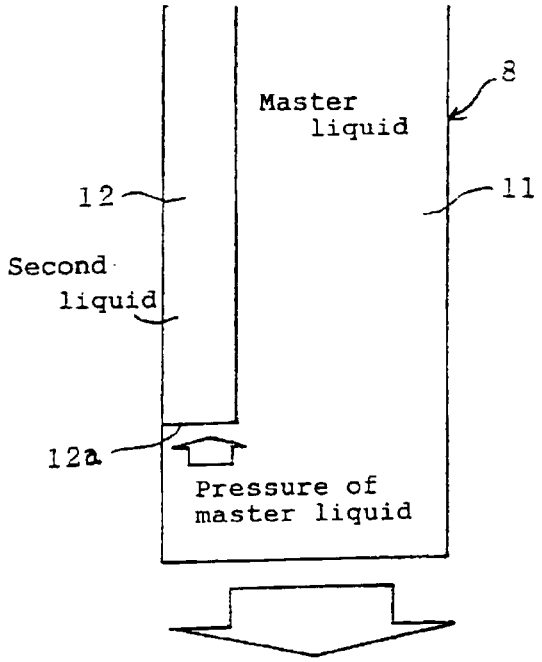
FIG. 2 schematically shows the concept of the present invention.

As mentioned above, the liquid composition supplying apparatus 8 according to the present invention can be used with the aforementioned automatic filling and packing machine. As shown in FIG. 2, the liquid composition supplying apparatus 8 includes a main conduit 11 for supply of only a liquid not containing granular constituents (will be referred to as "master liquid" hereinafter), of a liquid composition to be packed, and a sub conduit 12 for supply of a liquid containing granular constituents (will be referred to as "second liquid" hereinafter). The sub conduit 12 has an end 12*a* open in an area where a supply pressure for the master liquid acts.

Figure 3:
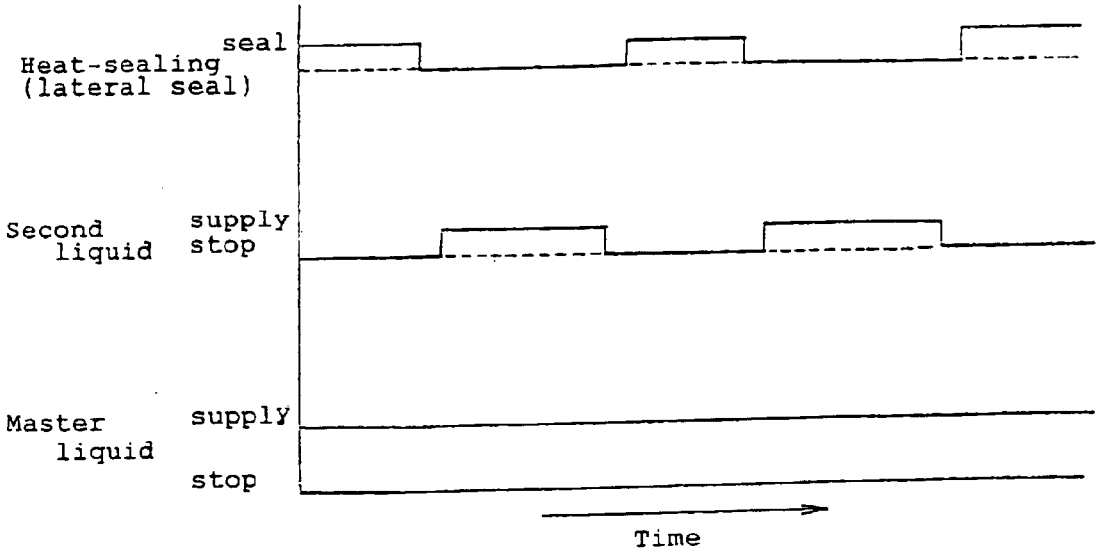
FIG. 3 graphically shows the relation between liquid supply timing and heat-sealing timing.

The liquid composition supplying apparatus 8 according to the present invention functions as will be described below. For the automatic supply and packing of a liquid composition containing granular constituents, the liquid composition is supplied into the film bag 4 formed with longitudinal and lateral seals given one after another to the continuously fed packing film 4, after forming the longitudinal seals, as mentioned above. As shown in FIG. 3, the master liquid is continuously supplied into the film bag 4 via the main conduit 11 and the bottom and top of the packing bag are formed by heat-sealing with the bag being stroked and squeezed to remove the master liquid from where the bottom and top seals are to be formed, while the second liquid is intermittently supplied into the packing bag between the bottom and top seals under a supply pressure higher than the pressure of the master liquid and which acts on the open end 12*a* of the sub conduit 12.

After the second liquid is intermittently supplied into the film bag 4, the open end 12*a* of the sub conduit 12 is acted on by the pressure of the master liquid always flowing through the main conduit 11 upon stopping the intermittent supply, that is, upon stopping the pressurization of the second liquid, so that the second liquid can be positively prevented from subsequently dripping or leaking from the open end 12*a* of the sub conduit 12 irrespectively of the viscosity of the second liquid.

Thus, the liquid composition containing granular constituents can automatically be supplied and packed efficiently for the same tact time as in continuous supply and packing of only the master liquid, and the bottom and top seals can be formed as in the above in such a manner as to purge the air from the packing bag, thereby effectively preventing the content of the film bag from being oxidized inside the bag, causing loss of flavor of the content.

In addition, the second liquid is intermittently supplied to the master liquid at a relatively low speed to prevent the second liquid containing granular constituents from jumping up. Thus, the distance between the bottom and top of the packing bag (film bag) has not to be intentionally increased, which contributes to an improved yield of the packing film and effective prevention of the bag content from being oxidized and lost in flavor inside the bag.

Further, the pressure of the master liquid can positively eliminate the likelihood that granular constituents in a drip of the second liquid will be caught between the films at the heat seals.

Note that for intermittent supply of the second liquid in a condensed state, the second liquid can be supplied in a large amount for a short time.

For supply and packing of the liquid composition, the liquid composition should desirably be separated into a master liquid not containing granular constituents and a second liquid containing granular constituents.

Figure 4A:
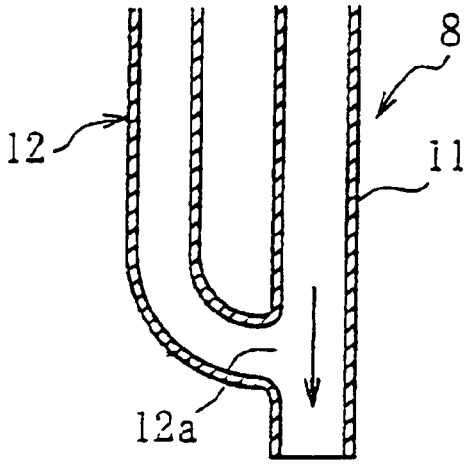
FIGS. 4(*a*) and 4(*b*) show embodiments of the present invention, respectively.
Figure 4B:
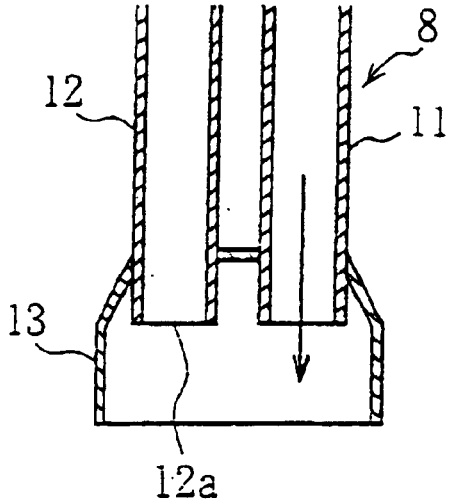

FIGS. 4(*a*) and 4(*b*) are detailed views of the liquid composition supplying apparatus 8 according to the present invention. As shown in FIG. 4(*a*), the open end 12*a* of the sub conduit 12 is located in the middle of main conduit 11 so that the pressure of the master liquid continuously flowing through the main conduit 11 is allowed to act on the open end 12*a* of the sub conduit 12. As shown in FIG. 4(*b*), the main and sub conduits 11 and 12 disposed in parallel to each other are open in a common nozzle 13 whose end opening is drawn perpendicularly to the plane of the drawing, to fill the nozzle 13 with the master liquid during other than the intermittent supply of the second liquid. Therefore, in this case as well, the pressure of the master liquid will act on the open end 12*a* of the sub conduit 12.

In any case, the second liquid will be applied with the higher supply pressure than that of the master liquid by a pump or the like (not shown), so that the second liquid will be intermittently supplied into the film bag 4 as necessary. After completion of the intermittent supply, as the supply pressure is not further applied, the second liquid will remain in the sub conduit 11 under the pressure of the master liquid, namely, it will not come out of the sub conduit 11.

Incidentally, when the master liquid is supplied by a pump or the like (not shown) under a pressure of 30 kPa as measured at the open end 12*a* of the sub conduit 11, the second liquid is supplied under a supply pressure of 40 kPa, which will assure an appropriate intermittent supplying.

In the above embodiment of the present invention, as shown in FIGS. 4(*a*) and 4(*b*), there is provided only one sub conduit 12 to supply the second liquid containing granular constituents into the packing bag. However, it should be noted that the present invention is not limited to this sub conduit 12 but more than one sub conduit 12 may of course be provided for the intermittent supply of more than one kind of liquid compositions each containing granular constituents.

Figure 5:
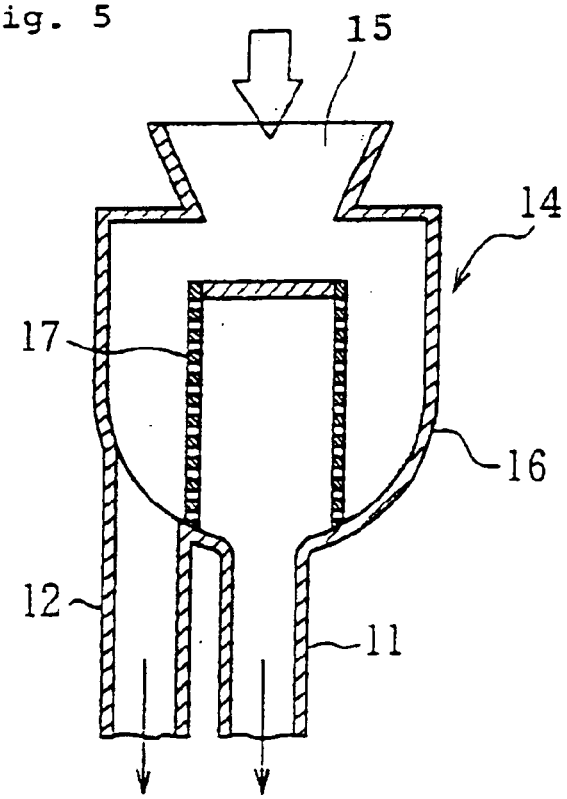
FIG. 5 is an axial-section of the separator.

FIG. 5 is an axial section of a separator coupled to the upstream ends of the main and sub conduits 11 and 12. The separator is generally indicated with a reference 14. As shown, the separator 14 consists of a body 16 having a liquid composition inlet 15 located at the top thereof and a filter 17 provided in the center thereof to filtrate granular constituents. The main conduit 11 is communicated with the inside of the filter 17 while the sub conduit 12 is communicated with the outside of the filter 17. Thus, the master liquid not containing the granular constituents can be supplied through the main conduit 11 while the second liquid containing the granular constituents can be supplied through the sub conduit 12. With a pump provided independently for each of the conduits 11 and 12, a required pressure can be applied to each of the master liquid and second liquid.

Note that the separator 14 may be of any well-known type such as a centrifugal separator or similar one.

As having been described in the foregoing, the liquid composition supplying apparatus according to the present invention permits to supply and pack a liquid composition containing granular constituents with a rather higher efficiency than that in the conventional intermittent supplying and packing, satisfactorily eliminate the likelihood that the drip of the second liquid containing granular constituents will be caught between the films at the heat seals, effectively prevent the content of the film bag formed by the packing machine from being oxidized inside the bag, and considerably improve the yield of the packing film.

What is claimed is:

1. An apparatus for supplying a liquid composition containing granular constituents into a packing bag formed from a continuously fed packing film by forming longitudinal and lateral seals in this order to the packing film, after forming the longitudinal seals, the apparatus comprising:

a packing bag forming system forming a packing bag from a packing film by making bottom and top seals, in this order, on the bag with stroking and squeezing of the packing film to remove a part of the master liquid from portions of the packing bag where the bottom and top seals are to be formed;

a main conduit through which only a master liquid, not containing the granular constituents, of the liquid composition is continuously supplied; and at least one sub conduit through which a second liquid, containing the granular constituents, of the liquid composition is intermittently and automatically supplied into the packing bag between the bottom and top seals, the sub conduit being open at a free end thereof in an area where pressure of the master liquid acts; and said packing bag forming system, said main conduct and said at least one conduit being structured and arranged so that pressure of the master liquid prevents the second liquid containing the granular constituents from dripping during periods when the second liquid is not automatically supplied.

2. The apparatus as set forth in claim 1, wherein the sub conduit is open at the free end thereof in the middle of the main conduit.

3. The apparatus as set forth in claim 1, wherein the main and sub conduits are open at respective ends in a common nozzle whose end is drawn.

4. The apparatus as set forth in claim 1, further comprising a separator to separate the liquid composition containing granular constituents into the master liquid and second liquid, the main and sub conduits being coupled to the separator.

5. The apparatus as set forth in claim 2, further comprising a separator to separate the liquid composition containing granular constituents into the master liquid and second liquid, the main and sub conduits being coupled to the separator.

6. The apparatus as set forth in claim 3, further comprising a separator to separate the liquid composition containing granular constituents into the master liquid and second liquid, the main and sub conduits being coupled to the separator.

* * * * *